US011062858B2

(12) United States Patent
Bach et al.

(10) Patent No.: US 11,062,858 B2
(45) Date of Patent: Jul. 13, 2021

(54) ELECTRICAL SWITCHING UNIT WITH SEPARABLE CONTACTS

(71) Applicant: Schneider Electric Industries SAS, Rueil Malmaison (FR)

(72) Inventors: Christian Bach, Seyssins (FR); Javier Herreros, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/992,710

(22) Filed: Aug. 13, 2020

(65) Prior Publication Data

US 2021/0082636 A1 Mar. 18, 2021

(30) Foreign Application Priority Data

Sep. 12, 2019 (FR) ..... 1910070

(51) Int. Cl.
*H01H 3/46* (2006.01)
*H01H 3/42* (2006.01)
(Continued)

(52) U.S. Cl.
CPC ..... *H01H 3/46* (2013.01); *H01H 3/42* (2013.01); *H01H 3/52* (2013.01); *H01H 3/38* (2013.01); *H01H 2003/326* (2013.01)

(58) Field of Classification Search
CPC .. H01H 3/46; H01H 3/42; H01H 3/52; H01H 3/38; H01H 3/32; H01H 3/60
(Continued)

(56) References Cited

U.S. PATENT DOCUMENTS 3,652,815 A * 3/1972 Davies ..... H01H 3/3021 200/400
4,114,005 A * 9/1978 Maier ..... H01H 3/60 200/288
(Continued)

FOREIGN PATENT DOCUMENTS

CN 205920942 * 2/2017 ..... H01H 71/10
CN 205920942 U 2/2017
(Continued)

OTHER PUBLICATIONS

Search Report and Written Opinion for French Patent Application No. FR1910070 dated May 7, 2020, 8 pages.
(Continued)

*Primary Examiner* — Edwin A. Leon
*Assistant Examiner* — Iman Malakooti
(74) *Attorney, Agent, or Firm* — Locke Lord LLP

(57) ABSTRACT

An electrical switching unit with separable contacts comprises a switching device comprising: a control lever coupled mechanically to a mobile electrical contact and an anti-bounce lever, mounted on the control lever and configured to be displaced to a deployed position to cooperate with an abutment to prevent the control lever from leaving its position.

The switching device comprises a fixed bearing mounted around the control lever. The anti-bounce lever comprises a contact portion which is in contact against an edge of the bearing when the anti-bounce lever is in its rest position and which is displaced along the edge when the control lever rotates about the bearing. The bearing comprises, on the edge, a guiding portion in the form of a cam configured to push the anti-bounce lever to its deployed position.

10 Claims, 3 Drawing Sheets

(51) Int. Cl.
*H01H 3/52* (2006.01)
*H01H 3/38* (2006.01)
*H01H 3/32* (2006.01)

(58) Field of Classification Search
USPC .. 200/43.16, 17 R, 329, 334, 337, 338, 400, 200/401
See application file for complete search history.

(56) References Cited

U.S. PATENT DOCUMENTS 4,144,427 A * 3/1979 Gryctko ..... H01H 71/504 200/288
9,373,457 B2 6/2016 Roelandt et al.

FOREIGN PATENT DOCUMENTS

| | | |
|---|---|---|
| CN | 107481901 | 12/2017 |
| EP | 0089463 | 9/1983 |
| EP | 2801099 B1 | 3/2016 |

OTHER PUBLICATIONS

English Language Machine Translation of Chinese Patent Application Publication No. CN107481901 published on Dec. 15, 2017, 9 pages.
English Language Abstract of Chinese Patent Application Publication No. CN205920942U published on Feb. 1, 2017, 1 page.

* cited by examiner

ELECTRICAL SWITCHING UNIT WITH SEPARABLE CONTACTS

BACKGROUND

The present invention relates to an electrical switching unit with separable contacts.

The electrical switching units with separable contacts, such as low-voltage circuit breakers, generally comprise, for each pole, a fixed electrical contact and a mobile electrical contact which can be displaced relative to one another by virtue of a switching mechanism to break the circulation of an electrical current. The patent EP 2 801 099 B1 describes an example of a switching unit.

One drawback of the known switching units is that, when the switching mechanism is actuated to separate the fixed and mobile contacts in order to break the circulation of the current, the mobile contact can reclose accidentally once it has arrived at the end of the opening travel, for example because of an uncontrolled bounce of one or more mobile parts of the switching mechanism.

If the contacts reclose accidentally, the electrical current can circulate again, while the unit is assumed to be in an off state. Such a situation must be avoided for safety reasons.

SUMMARY

It is this drawback that the invention sets out more particularly to remedy by proposing an electrical switching unit with separable contacts in which the risk of accidental closure of the electrical contacts is reduced.

According to one aspect of the invention, an electrical switching unit with separable contacts comprises a switching device comprising:

a fixed electrical contact and a mobile electrical contact that can be displaced between a closed position and an opened position;

a control lever coupled mechanically to the mobile electrical contact, the control lever being rotationally mobile, about a first axis rotation, between a first position and a second position, by being configured so that the displacement of the control lever from the first position to the second position causes a displacement of the mobile contact from the closed position to the opened position;

an anti-bounce lever, mounted on the control lever by a pivot link and that can be displaced, by virtue of the pivot link, in rotation about a second axis of rotation parallel to the first axis of rotation, between a rest position and a deployed position, the anti-bounce lever being configured to be displaced from the rest position to the deployed position when the control lever reaches the second position and to cooperate with an abutment of the switching device when the anti-bounce lever is in its deployed position and the control lever is in the second position to prevent the control lever from leaving the second position;

wherein the switching device comprises a fixed bearing mounted around the control lever, the anti-bounce lever comprising a contact portion which is in contact against an edge of the fixed bearing when the anti-bounce lever is in its rest position and which is displaced along said edge when the control lever rotates about the bearing, and wherein the fixed bearing comprises, on said edge, a guiding portion in the form of a cam configured to push the anti-bounce lever to its deployed position.

According to advantageous but non-mandatory aspects of the invention, such a switching unit can incorporate one or more of the following features, taken along or in any technically admissible combination:

- The contact portion takes the form of a protuberance directed at right angles to the plane of the anti-bounce lever.
- The fixed bearing takes the form of a ring.
- The fixed bearing is secured to a framework of the unit.
- The anti-bounce lever extends essentially in a geometrical plane at right angles to the first and second axes of rotation.
- The anti-bounce lever comprises a first lobe and a second lobe that are linked to one another by a central part, the pivot link between the anti-bounce lever and the control lever being formed in one of the lobes of the anti-bounce lever.
- The control lever comprises a first arm on which is formed the pivot link with the anti-bounce lever and a second arm on which is formed another pivot link with a connecting piece connected to the mobile contact to ensure the coupling between the control lever and the mobile contact, the first arm and the second arm being at right angles to the first axis of rotation and being secured to a control shaft of the unit extending along the first axis of rotation and wherein the fixed bearing is mounted around said control shaft.
- The abutment is arranged to limit the travel of the control lever between the first position and the second position.
- The abutment is in contact with the second arm when the control lever is in the second position and in contact with the first arm when the control lever is in the first position.
- The unit is a multipole unit comprising one or more additional switching devices similar to the switching device, the unit also comprising a control shaft common to the switching devices to simultaneously control the displacement of the respective control levers of the switching devices.

BRIEF DESCRIPTION OF THE DRAWINGS

The invention will be better understood and other advantages thereof will become more clearly apparent in light of the following description of an embodiment of a switching unit given purely by way of example and with reference to the attached drawings, in which.

DETAILED DESCRIPTION

Figure 1:
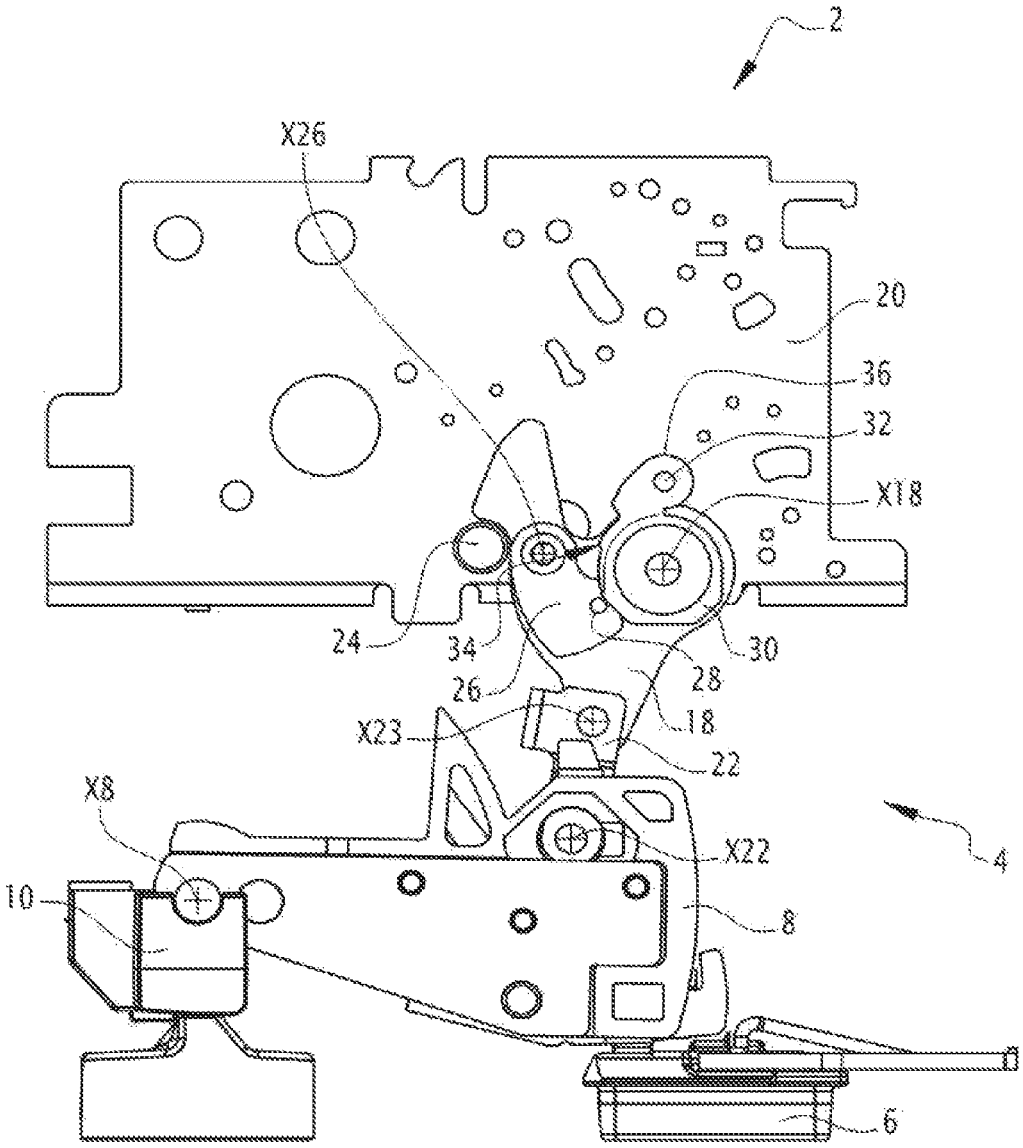
FIG. 1 schematically represents a cross-sectional view of an electrical switching unit according to embodiments of the invention, in which the separable contacts are closed.
Figure 2:
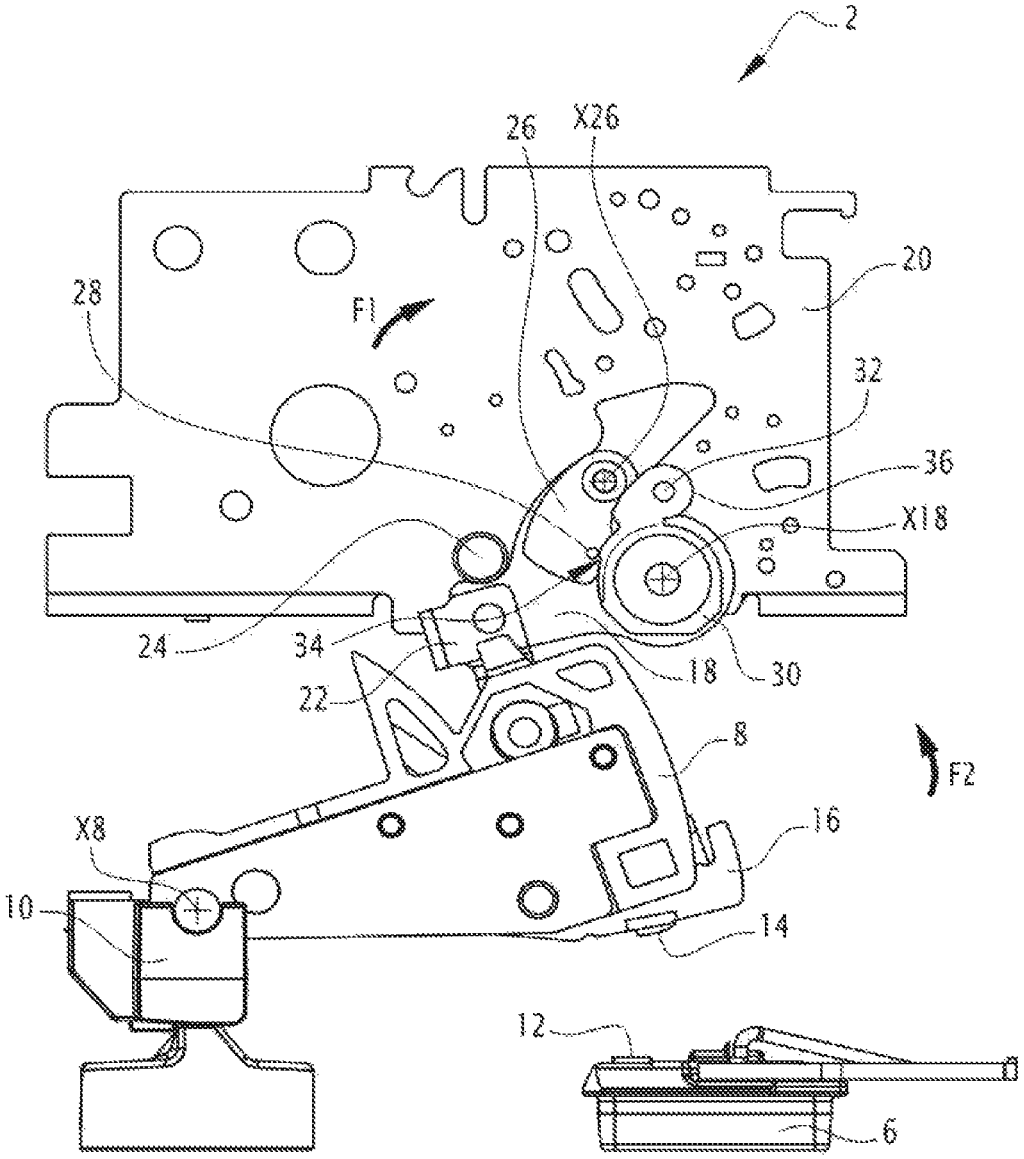
FIG. 2 schematically represents the unit of FIG. 1, in which the separable contacts are open.
Figure 3:
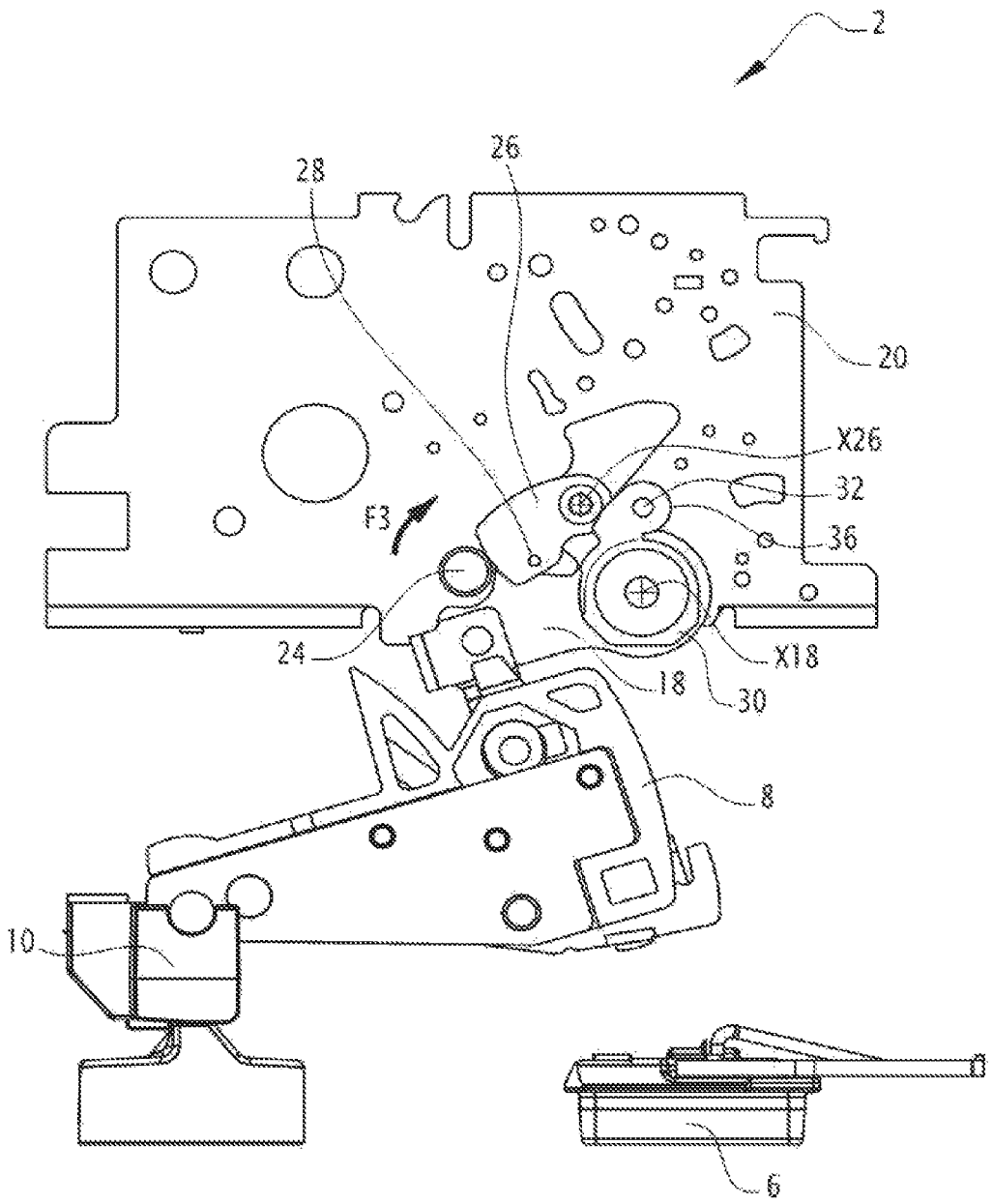
FIG. 3 schematically represents the unit of FIG. 1, in which the separable contacts are open and in which an anti-bounce lever is displaced into its deployed position.

FIGS. 1 to 3 represent an electrical switching unit 2, such as a contactor, or a circuit breaker, or a relay, for example intended to be connected to an electricity distribution installation.

The unit 2 comprises a switching device 4 with separable contacts and a switching mechanism coupled to the separable contacts of the device 4 to switch between open and closed states between off and on states, for example in response to a trip command sent from a trip or from a control member.

In this example, only one pole of the unit 2 is described. However, according to implementations, the unit 2 is a multipole unit and comprises several poles, each including a device 4 similar to that described. In this case, the description of the device 4 can be transposed to the other poles of the unit 2.

For example, the unit 2 comprises three or four poles to be connected to a three-phase installation. In other cases, the unit 2 can comprise a single pole.

The device 4 comprises a fixed electrical contact 6 and a mobile electrical contact 8, connected to respective connection terminals of the unit 2.

The mobile contact 8 can be displaced between a closed position and an open position relative to the fixed contact 6 to, respectively, allow and prevent the circulation of an electrical current between the contacts 6 and 8.

For example, the mobile contact 8 is mounted to pivot relative to a fixed support 10 of the device 4 and is displaced between the open and closed positions by rotation about an axis of rotation X8.

The mobile contact 8 is illustrated in the closed position in FIG. 1 and in the open position in FIGS. 2 and 3.

According to examples, as illustrated in FIG. 2, the device 4 comprises electrically conductive contact pads 12 and 14 mounted respectively on the fixed contact 6 and the mobile contact 8.

For example, the mobile contact 8 comprises one or more contact fingers 16 mounted to pivot relative to the contact 8, each contact finger 16 bearing one of the contact pads 14.

The device 4 also comprises a control lever 18 coupled mechanically to the mobile electrical contact 8.

The control lever 18 is rotationally mobile about an axis of rotation X18 parallel to the axis X8, between a first position and a second position.

The control lever 18 is in the first position in FIG. 1 and in the second position in FIGS. 2 and 3.

For example, the displacement of the control lever 18 from the first position to the second position causes a displacement of the mobile contact 8 from the closed position to its open position.

Reciprocally, the displacement of the control lever 18 from the second position to the first position causes a displacement of the mobile contact 8 from the open position to its closed position.

In the example illustrated, the control lever 18 is mobile relative to a framework 20 of the unit 2. The control lever 18 is coupled mechanically to the mobile contact 8 via a connecting piece 22, here of rectilinear form.

According to examples, the connecting piece 22 is mounted to pivot relative to the mobile contact 8 by a first pivot link of axis of rotation X22 and is also mounted to pivot relative to the control lever 18 by a second pivot link of axis X23. The axes X22 and X23 are parallel.

Other provisions can be used to mechanically couple the control lever 18 to the mobile contact 8.

According to implementations, the control lever 18 forms part of a control shaft, also called pole shaft, aligned with the axis X18 and that can rotate about the axis X18. The control shaft is for example coupled with the trip mechanism of the unit 2.

The control lever 18 is secured with the shaft to rotate about the axis X18. For example, the control lever 18 is formed by one or more cams of the control shaft.

In the example illustrated, the control lever 18 comprises a first arm and a second arm, not referenced but visible in FIGS. 1 to 3.

The first arm and the second arm are at right angles to the axis X18 and are secured to the control shaft. Said arms extend by protruding radially relative to the control shaft. Said arms here are of essentially planar form and extend in a geometrical plane at right angles to the axis X18.

As a variant, other configurations of the control lever 18 can be envisaged.

According to variants, in the case where the unit 2 comprises several poles, the control shaft is preferably common to the switching devices 4 of the different poles so as to be able to simultaneously control the displacement of the respective control levers 26 of these devices 4.

For example, each pole of the unit 2 is associated with a dedicated compartment in a housing of the unit 2. The compartments are aligned side-by-side along the axis X18. The control shaft passes through the lateral walls separating two adjacent compartments through dedicated through orifices.

The device 4 also comprises a fixed abutment 24, for example fixedly mounted on the framework 20 and whose function is explained hereinbelow. For example, the abutment 24 comprises a rod or a rigid protuberance protruding relative to the framework 20 by extending parallel to the axis X18.

According to examples, the abutment 24 limits the displacement of the control lever 18 between the first position and the second position by coming into contact with the first and second arms so as to block the rotation of the shaft.

More specifically, the abutment 24 is, here, in contact with the first arm when the control lever 18 is in the second position, to prevent the control lever 18 from continuing its movements beyond the second position. The abutment 24 is in contact with the second arm when the control lever 18 is in the first position, to prevent the control lever 18 from rotating, in the opposite direction, beyond the first position. As a variant, in the first position, the edge of the second arm can be very close to the abutment 24 without in any way being directly in contact with the abutment 24.

Thus, in this example, the abutment 24 is arranged to limit the travel of the control lever 18 both between the first position and the second position.

The device 4 also comprises an anti-bounce lever 26, mounted on the control lever 18 by a pivot link. The control lever 18 can be displaced, relative to the control lever 18, by virtue of the pivot link, by rotation about an axis of rotation X26, between a rest position, also called retracted position, and a deployed position.

The axis X26 is secured to the control lever 18 and is parallel to the axis X18. In other words, the axis X26 and the corresponding pivot link are displaced with the control lever 18.

In the rest position, the control lever 26 does not prevent the movement of the control lever 18. For example, the anti-bounce lever 26 is then folded back on a body of the control lever 18.

The anti-bounce lever 26 is arranged to cooperate with the abutment 24 when it is in its deployed position and when the control lever 18 is in the second position, so as to prevent the control lever 18 from leaving the second position.

The anti-bounce lever 26 is moreover arranged to be displaced from its rest position to its deployed position when the control lever 18 reaches the second position at the end of a displacement from the first position.

In the example illustrated, the anti-bounce lever 26 has a flat and rounded form and comprises a contact portion 28.

For example, the contact portion 28 takes the form of a protuberance, such as a rod or a pin. The contact portion 28 extends at right angles to the plane of the anti-bounce lever 26, that is to say directed parallel to the direction of the first axis of rotation X18.

In the examples described, when the control lever 18 is in the second position and the anti-bounce lever 26 is deployed, the first arm and the anti-bounce lever 26 are situated on either side of the abutment 24, in the immediate vicinity of the abutment 24, even in direct contact with the abutment 24. Thus, the displacement of the control lever 18 (and therefore of the shaft) is made impossible as long as the anti-bounce lever 26 remains in its deployed position.

In practice, the first arm and the anti-bounce lever 26 are not necessarily constantly both in direct contact with the abutment 24, such that a small travel in the vicinity of the second position can be allowed in such a case for the control lever 18.

According to implementations, the pivot link linking the piece 22 to the control lever 18 is mounted on the first arm. The pivot link linking the control lever 18 to the anti-bounce lever 26 is mounted on the second arm.

The first and second arms are, here, linked by a rounded portion in the form of a circular arc centred on the axis X18. In the folded-back position, the anti-bounce lever 26 covers the rounded portion and the top edge of the anti-bounce lever 26 is aligned with the outer edge of the rounded portion. The anti-bounce lever 26 does not then extend beyond the rounded portion, so as not to prevent the displacement of the control lever 18 and of the shaft.

The switching device 4 also comprises a fixed bearing 30 mounted around the control lever 18.

For example, the bearing 30 is mounted around the c control shaft of the control lever 18.

According to examples, the bearing 30 takes the form of a ring centred on the axis of rotation X18.

In an example given as an illustration and that is not necessarily limiting, the diameter of the bearing 30 is greater than or equal to 15 mm or 20 mm.

The bearing 30 can be made of metal, such as bronze, or of hardened polymer, or of any appropriate material.

In the example illustrated, the bearing 30 is secured to the framework 20 of the unit 2, for example using a link piece 32 mounted on the framework 20. For example, the bearing 30 comprises a connecting portion 36 in lobe form to which the link piece 32 is connected.

According to embodiments, the anti-bounce lever 26 and the bearing 30 are configured such that the contact portion 28 is in contact against an edge of the bearing 30 when the anti-bounce lever 26 is in its rest position and the contact portion 28 is displaced along said edge when the control lever 18 rotates about the bearing 30.

Advantageously, the contact portion 28 is kept in direct contact against the edge of the bearing 30 under the effect of an elastic return member, such as a torsion spring, which tends to return the anti-bounce lever 26 to its rest position. The torsion spring is for example mounted in association with the anti-bounce lever 26.

The bearing 30 comprises, on said edge, a guiding portion 34 in the form of a cam configured to push the anti-bounce lever 26 to its deployed position.

For example, the edge of the bearing 30 comprises an inclined part which locally radially moves away from the axis of rotation X18 to form at least a first part of the guiding portion 34.

An example of operation of the device 4 is now described with reference to FIGS. 1 to 3.

Initially, the device 4 is in the off state, as illustrated in FIG. 1. The conductive parts of the contacts 6 and 8 are touching and the electrical current can circulate.

The control lever 18 is in the first position. For example, an edge of the second arm is in contact with the abutment 24, or very close to the abutment 24, for example at a distance of less than five millimetres from the abutment 24. The anti-bounce lever 26 is in the rest position.

Then, the switching mechanism is tripped to open the device 4, that is to say to separate the contacts 6 and 8 and to interrupt the current.

For that, the control lever 18 is rotated about the axis X18, for example by turning the shaft in a first direction of rotation, illustrated by the arrow F1 in FIG. 2. This movement is transmitted by the piece 22 to the mobile contact 8 which then rotates about the axis X8 in a second direction of rotation, illustrated by the arrow F2. At this stage, the anti-bounce lever 26 remains in the rest position, that is to say that it remains immobile relative to the control lever 18.

However, the anti-bounce lever 26 rotates with the control lever 28 about the axis of rotation X18 relative to the fixed bearing 30. That being so, the contact portion 28 follows the edge of the bearing 30, for example by sliding in contact along this edge.

When the contact portion 28 encounters the guiding portion 34, it is pushed radially by the guiding portion 34, which forces it to move away from the axis of rotation X18 and begins the displacement of the anti-bounce lever 26 to the deployed position.

The anti-bounce lever 26 then continues its displacement to the deployed position under the effect of the centrifugal force due to the rotation of the control lever 18. For example, this centrifugal force is sufficient to overcome the return effect exerted by the return member.

In parallel, the rotational movement of the control lever 18 continues until the control lever 18 reaches the second position, that is to say that it arrives at the end of travel. The end of travel corresponds here to the position in which the first arm enters into contact with the abutment 24, as illustrated in FIG. 2.

In practice, when the control lever 18 arrives in its second position at the end of travel, it is likely, because of its speed, to bounce and then be displaced in the reverse direction towards its first position.

In the example illustrated, the first arm strikes the abutment 24 when it arrives at the end of travel. In FIG. 3, the control lever 18 has also begun to leave the second position and the first arm has begun to move away a little from the abutment 24.

Once the anti-bounce lever 26 is deployed and in contact against the abutment 24, the control lever 18 can no longer continue to move away from the second position, which prevents an accidental reopening of the contacts 6 and 8.

Advantageously, the position of the guiding portion 34 on the bearing 30, which determines the angular position from which the contact portion 28 begins to be pushed radially away from the axis of rotation X18 as the anti-bounce lever 26 rotates about the axis of rotation 18, is chosen as a function of the angular position of the abutment 24, such that the displacement of the anti-bounce lever 26 to its deployed position begins and ends before the control lever 18 arrives in abutment against the abutment 24.

Once deployed, the anti-bounce lever 26 prevents the control lever 18 from leaving its second position, by cooperating with the abutment 24, even if the control lever 18 bounces back against the abutment and has begun to move away therefrom, as is the case here. The control lever 18 then remains in the vicinity of the second position. The contact 8 cannot therefore reclose accidentally.

Thus, the risk of accidental closure of the mobile contact 8 is reduced. The operation of the unit 2 is therefore more secure.

In particular, the displacement of the anti-bounce lever 26 is not contingent on the speed of rotation of the control lever 18. In particular, the guiding portion 34 makes it possible to begin the displacement of the anti-bounce lever 26 to its deployed position even when the centrifugal force resulting from the rotation of the control lever 18 is not sufficient to initiate this movement.

The risk of accidental reopening of the contact 8 is therefore reduced, independently of the circumstances in which the trip occurs, even when the control lever 18 is displacing slowly.

Furthermore, the anti-bounce lever 26 is easy to incorporate in the unit 2 without it being necessary to completely modify the architecture of the device 4.

In practice, the anti-bounce lever 26 can then be returned to its rest position, for example once the control lever 18 is immobilized in the second position.

The return to the rest position can be achieved manually or by gravity or by an elastic return member.

The embodiments and the variants considered above can be combined with one another to generate new embodiments.

The invention claimed is:

1. An electrical switching unit with separable contacts, comprising a switching device comprising:

a fixed electrical contact and a mobile electrical contact that can be displaced between a closed position and an opened position;

a control lever coupled mechanically to the mobile electrical contact, the control lever being rotationally mobile, about a first axis of rotation, between a first position and a second position, by being configured so that the displacement of the control lever from the first position to the second position causes a displacement of the mobile contact from the closed position to the opened position;

an anti-bounce lever, mounted on the control lever by a pivot link and being able to be displaced, by virtue of the pivot link, in rotation about a second axis of rotation parallel to the first axis of rotation, between a rest position and a deployed position; the anti-bounce lever being configured to be displaced from the rest position to the deployed position when the control lever reaches the second position and to cooperate with an abutment of the switching device when the anti-bounce lever is in its deployed position and the control lever is in the second position to prevent the control lever from leaving the second position;

wherein the switching device comprises a fixed bearing mounted around the control lever, the anti-bounce lever comprising a contact portion which is in contact against an edge of the fixed bearing when the anti-bounce lever is in its rest position and which is displaced along said edge when the control lever rotates about the bearing, and wherein the fixed bearing comprises, on said edge, a cam-shaped guiding portion configured to push the anti-bounce lever to its deployed position.

2. The electrical switching unit according to claim 1, wherein the contact portion takes the form of a protuberance directed at right angles to the plane of the anti-bounce lever.

3. The electrical switching unit according to claim 1, wherein the fixed bearing is in the form of a ring.

4. The electrical switching unit according to claim 1, wherein the fixed bearing is secured to a framework of the unit.

5. The electrical switching unit according to claim 1, wherein the anti-bounce lever extends essentially in a geometrical plane at right angles to the first and second axes of rotation.

6. The electrical switching unit according to claim 1, wherein the anti-bounce lever comprises a first lobe and a second lobe that are linked to one another by a central part, the pivot link between the anti-bounce lever and the control lever being formed by one of the lobes of the anti-bounce lever.

7. The electrical switching unit according to claim 1, wherein the control lever comprises a first arm on which is formed the pivot link with the anti-bounce lever and a second arm on which is formed another pivot link with a connecting piece connected to the mobile contact to ensure the coupling between the control lever and the mobile contact, the first arm and the second arm being at right angles to the first axis of rotation and being secured to a control shaft of the unit extending along the first axis of rotation and wherein the fixed bearing is mounted around said control shaft.

8. The electrical switching unit according to claim 1, wherein the abutment is arranged to limit the travel of the control lever between the first position and the second position.

9. The electrical switching unit according to claim 7, wherein the abutment is arranged to limit the travel of the control lever between the first position and the second position and wherein the abutment is in contact with the second arm when the control lever is in the second position and in contact with the first arm when the control lever is in the first position.

10. The electrical switching unit according to claim 1, wherein the unit is a multipole unit comprising one or more additional switching devices similar to the switching device, the unit also comprising a control shaft common to the switching devices to simultaneously control the displacement of the respective control levers of the switching devices.

* * * * *